US007871072B2

(12) United States Patent
Rowe et al.

(10) Patent No.: US 7,871,072 B2
(45) Date of Patent: Jan. 18, 2011

(54) MEDIA TRAY MEDIA BIASING DEVICES

(75) Inventors: Jason Lee Rowe, Richmond, KY (US); Darin M. Gettelfinger, Lexington, KY (US); Franklin Joseph Palumbo, Nicholasville, KY (US); Philip David Jones, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 171 days.

(21) Appl. No.: 11/851,416

(22) Filed: Sep. 7, 2007

(65) Prior Publication Data

US 2009/0066002 A1 Mar. 12, 2009

(51) Int. Cl.
*B65H 9/00* (2006.01)

(52) U.S. Cl. ..... 271/234; 271/171; 271/248

(58) Field of Classification Search ..... 271/145, 271/171

See application file for complete search history.

(56) References Cited

U.S. PATENT DOCUMENTS

2006/0255531 A1* 11/2006 Azzopardi et al. ..... 271/171
2010/0117291 A1* 5/2010 Bridges et al. ..... 271/171

FOREIGN PATENT DOCUMENTS

JP 01256428 A * 10/1989
JP 05105243 A * 4/1993

* cited by examiner

*Primary Examiner*—Gene Crawford
*Assistant Examiner*—Gerald W McClain

(57) ABSTRACT

The present application is directed to methods and devices for aligning media sheets in an input tray of an image forming device. The input tray includes a support surface and at least two spaced apart side walls. A first side wall includes a reference surface to align the media sheets. A second side wall includes a plurality of biasing members. The biasing members bias the media sheets toward the reference surface.

13 Claims, 9 Drawing Sheets

MEDIA TRAY MEDIA BIASING DEVICES

BACKGROUND

The present application is directed to methods and devices for aligning media sheets in an image forming device, and more specifically to aligning the media sheets in an input tray.

Image forming devices, such as a color laser printer, facsimile machine, copier, all-in-one device, etc, move media sheets along a media path. The media sheets initially begin at an input tray that is sized to hold a stack of sheets. Each sheet is individually picked from the stack and introduced into the media path. The input tray may use side restraints to constrain and initially position the media sheets. Due to variability in loading the media sheets into the input tray, as well as dimensional tolerances in the media sheets and the input tray, all of the media sheets in the input tray may not be consistently and properly aligned. This may cause decreased feed reliability and skewing of the media sheets relative to the media path, which may result in print defects.

The movement of the media sheets from the input tray should occur without media jams and/or print defects. Media jams require the user to determine the location of the jam, access and remove the jammed sheet(s), and restart the image formation process. Print defects occur when the media sheet is not properly aligned when moving through the imaging area. Misalignment may occur in the scan directions (i.e., left and right), as well as the process directions (i.e., forward and backward).

A prior art input tray 10 is illustrated in FIG. 1. An input area 12 includes the support surface 15 sized to support the stack of media sheets 11 (not shown). A first side wall 13 extends vertically upward from the support surface 15. The first side wall 13 includes a reference surface 16. An edge of the media sheets 11 contacts the reference surface 16 to align the media sheets 11 in a proper orientation prior to feeding into the image forming device. A second side wall 17 extends vertically upward from the support surface 15 and is disposed opposite the first side wall 13. Located adjacent to the second side wall 17 is an adjustment plate 18. The adjustment plate 18 is movable along the support surface 15 by engaging a series of grooves 19 in the support surface 15. Moving the adjustment plate 18 in the scan direction along the grooves 19 varies a distance between the adjustment plate 18 and the reference surface 16 to accommodate a variety of media sheet 11 sizes.

The input tray 10 may also include a first end wall 20. As illustrated in FIG. 1, the first end wall 20 may be positionable at an angle to the support surface 15 to offset the stack at an angle to facilitate feeding the media sheets 11. First end wall 20 may also be movable in the feed direction to accommodate a variety of media sheet 11 sizes. The input tray 10 may also include a second end wall 21.

The input tray 10 may be inserted into the image forming device. Once inserted, a pick mechanism (not shown) may be positioned at the input area 12 to introduce the top-most media sheet 11 in the stack of media sheets 11 into the media feed path. Examples of image forming devices with pick mechanisms for introducing media sheets include Model C750 from Lexmark International of Lexington, Ky.

A function of the input tray 10 is to properly position the media sheets 11 so that each media sheet 11 is properly aligned with the media path. Improperly aligned media sheets 11 may misfeed when entering the media path, or may be skewed. One embodiment of a prior art device to align media sheets 11 in the media tray 10 is illustrated in FIG. 2. This embodiment includes a movable biasing side wall 18 that contacts an edge of the stack of media sheets 11. A biasing mechanism 32 such as a spring urges the biasing side wall 18 against the edge of the stack of media sheets 11, biasing the media sheets 11 against the reference surface 16 for proper alignment.

However, the size of the media sheets 11 may vary within a certain tolerance, and the media sheets 11 may not be placed consistently in the input tray 11. FIG. 2 illustrates how conditions such as these may cause an uneven edge 30 of the stack of media sheets 11. In this example, the biasing side wall 18 may contact an uneven section 30 of the edge, leaving gaps 31 between the biasing side wall 18 and the stack of media sheets 11. Without the biasing side wall 18 biasing the media sheets 11 near the top of the stack toward the reference surface 16, the top-most media sheet 11 may misfeed or skew when entering the media path.

The biasing side wall 18 illustrated in FIG. 2 may be constructed to have a sufficient biasing force to adequately bias a full stack of media sheets 11. When the stack of media sheets 11 is reduced and is near to being depleted, the remaining media sheets 11 will be subject to the full biasing force of the adjustment arm 11. While this force may be necessary when a full stack of media sheets 11 is present, the full biasing force may overwhelm the last remaining media sheets 11 and cause buckling or creasing of the media sheets. This may cause misfeeds or may damage the edge of the media sheets 11.

SUMMARY

The present application is directed to methods and devices for aligning media sheets in an input tray of an image forming device. The input tray includes a support surface and at least two spaced apart side walls. A first side wall includes a reference surface to align the media sheets. A second side wall includes a plurality of biasing members. The biasing members bias the media sheets toward the reference surface.

DETAILED DESCRIPTION

Figure 3:
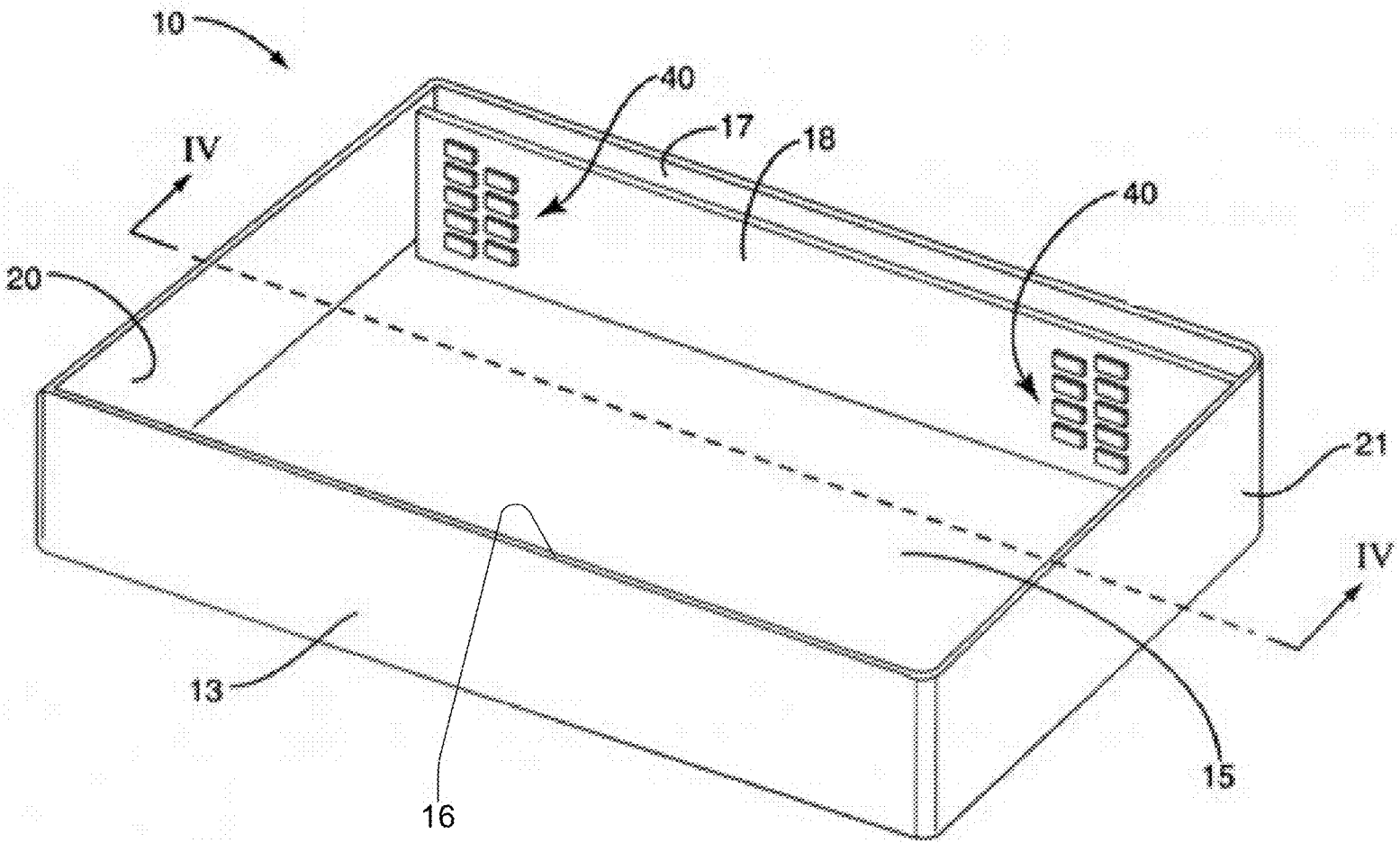
FIG. 3 is a perspective view of an input tray according to one embodiment.

FIG. 3 illustrates an embodiment of the present application that includes an input tray 10 including a biasing side wall 18 with a plurality of independently movable contact surfaces 40 to contact an edge of a stack of media sheets 11. The contact surfaces 40 extend outward from the biasing side wall 18 and provide multiple contact surfaces to bias the media sheets 11 toward a reference surface 16 on a reference side wall 13. As described in more detail below, the multiple contact surfaces 40 allow the top-most media sheets 11 to be biased against the reference surface 16 even when a variety of uneven edge conditions exists in the stack of media sheets 11.

The input tray 12 may also include a support surface 15 and at least one additional side wall 17. The support surface 15 is sized to support a stack of media sheets 11. The additional side wall 17 may be positioned adjacent to the biasing side wall 18 and spaced apart from the reference side wall 13, and may provide structural support for the input tray 10. In another embodiment, the input tray 10 does not include the additional side wall 17, and support may be provided by the biasing side wall 18.

Figure 4:
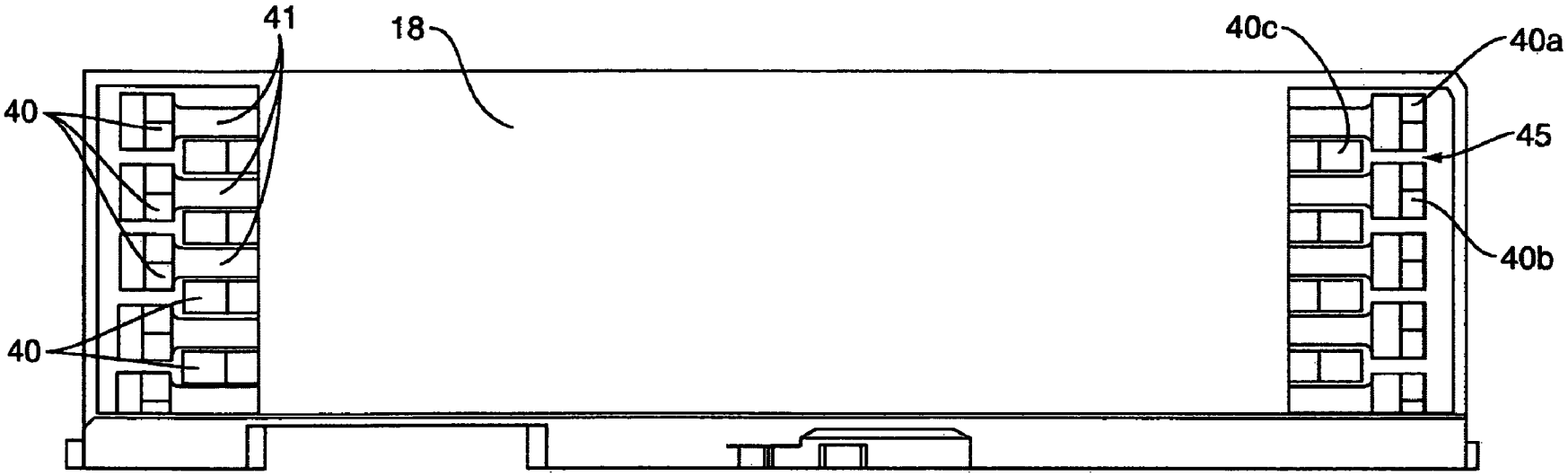
FIG. 4 is a sectional view of an input tray according to one embodiment.

FIG. 4 illustrates one embodiment of the biasing members 40. The biasing members 40 are arranged in two spaced apart groups. In this embodiment, the groups of biasing members 40 are disposed in proximity to each end of the biasing side wall 18. The biasing members 40 generally contact at least two points near the ends of each media sheet 11, which facilitates proper alignment against the reference surface 16. The biasing members 40 may be arranged in other numbers of groups, including a single group.

Figure 5:
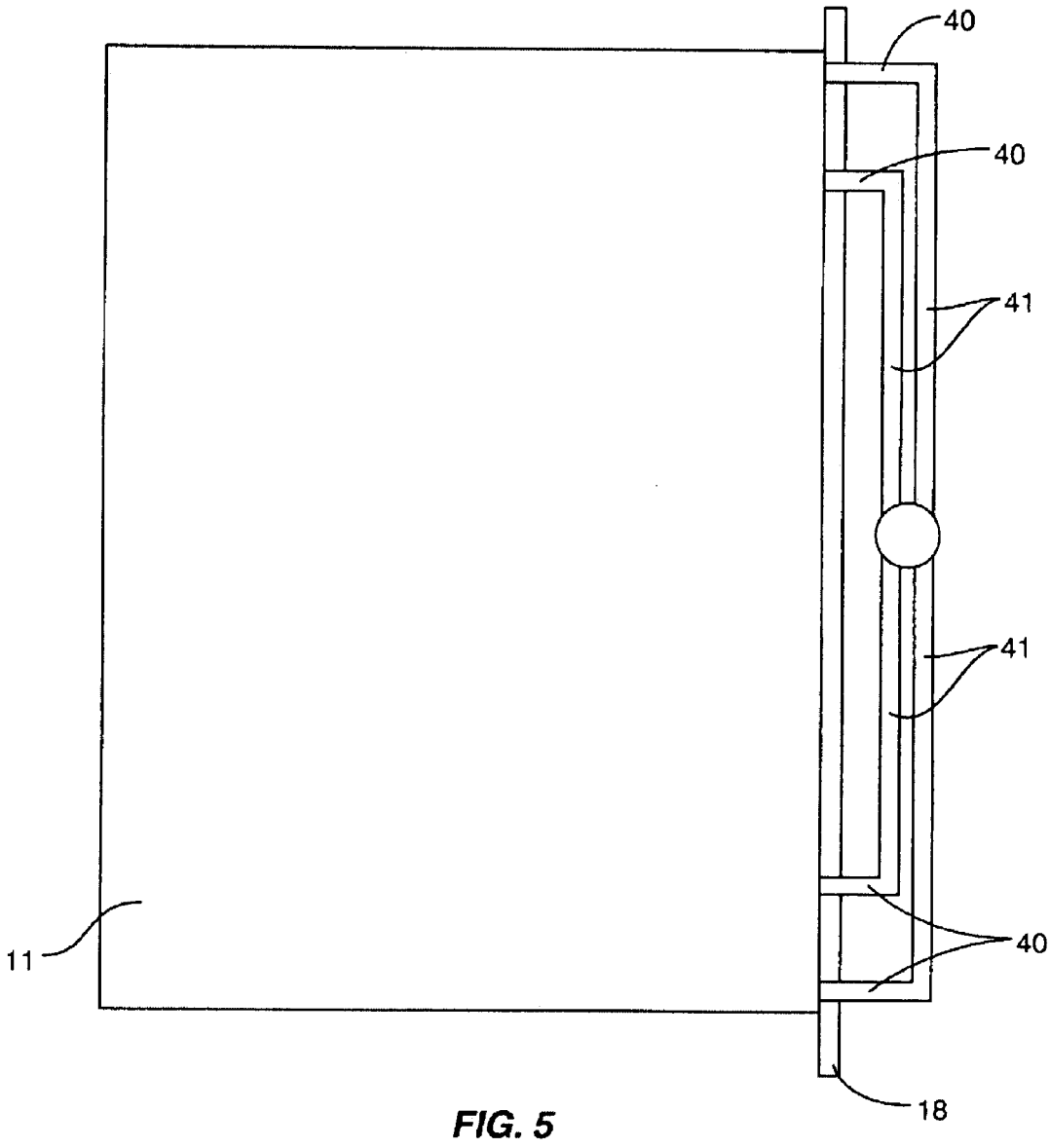
FIG. 5 is a schematic view of biasing members according to one embodiment.

In the embodiment illustrated in FIGS. 4 and 5, the biasing members 40 are shaped to include an arm portion 41 that facilitiates connection to the biasing side wall 18. The biasing members 40 may be constructed of a resilient material. As such, this shape may also allow the biasing members 40 to bend when a force is applied, such as when a stack of media sheets 11 is placed into the input tray 10, and return to an original position when the media sheets 1 1 are removed.

Figure 6:
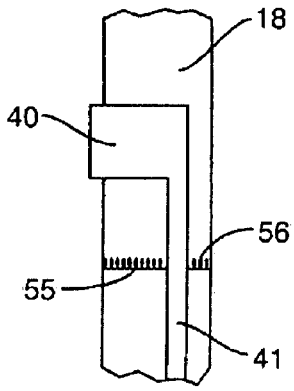
FIG. 6 is a schematic view of a biasing member according to one embodiment.

In another embodiment illustrated in FIG. 6, a first spring 55 and a second spring 56 are located on opposite sides of the biasing member 40. The springs 55, 56 urge the biasing member 40 to a position extending outward from the biasing side wall 18 and in contact with the edge of the stack of media sheets 11. The first spring 55 may pull the biasing member 40 to this position, and the second spring may push the biasing member 40 to this position. One embodiment may include only one spring 55 urging the biasing member 40, and another embodiment may include only one spring 56 urging the biasing member 40. In yet another embodiment, more than one spring 55, 56 may be positioned on either side of the biasing member 40. Other embodiments may use resilient materials, such as rubber or foam, to provide the biasing force, rather than a spring. The biasing mechanism may be constructed as a single piece, or from more than one piece.

Figure 7:
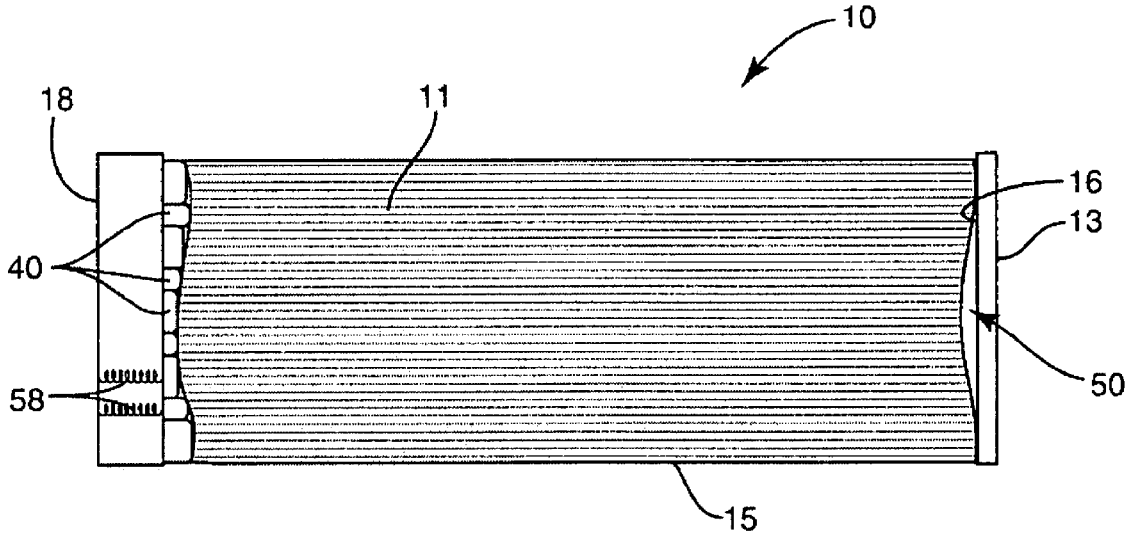
FIG. 7 is a side view of an input tray according to one embodiment.

In the embodiment illustrated in FIG. 7, the biasing member 40 does not include the arm portion 41. A spring 58 (or a resilient material) may be positioned in contact with the biasing member 40 to urge the biasing member 40 to a position extending outward from the biasing side wall 18 and in contact with the edge of the stack of media sheets 11.

Because media sheets 11 are fed only from the top of the stack, precise alignment of the media sheets 11 is required only for an upper portion of the stack. Thus, there is generally no need to bias a lower portion of the stack of media sheets 11 against the reference surface 16 until the upper portion of the stack of media sheets 11 has been fed. The plurality of biasing members 40 illustrated in FIG. 4 allows selective biasing of the top-most portion of the stack of media sheets 11. Since the biasing members 40 are divided into a plurality of small biasing members 40 rather than one large surface such as that illustrated in FIG. 2, the force applied by any one biasing member 40 may be relatively small. When a full stack of media sheets 11 is present in the input tray 10, the biasing members 40 located closer to the support surface 15 may not exert sufficient force to overcome the weight of the stack of media sheets 11. Thus, these biasing members 40 may not affect the alignment of the media sheets 11 until most of the media sheets 11 above them have been fed. As such, only the biasing members 40 located at or near the top-most media sheet 11 in the stack may influence the alignment of the media sheets 11.

FIG. 4 also illustrates two laterally arranged columns of biasing members 40 in each group. Each biasing member 40 directly contacts a limited vertical section of the stack of media sheets 11. Because of the plurality of biasing members 40, a gap 45 exists between each vertically adjacent pair of biasing members 40 within each column. Even if the gap 45 is small, the possibility exists that one or more media sheets 11 could fit within the gap 45, and these media sheets 11 may not be biased toward the reference surface 16. By offsetting the two columns so that the biasing members 40 in one column overlap the gaps 45 between the biasing members 40 in the other column, the gaps 45 may be effectively eliminated. For example, two biasing members 40*a*, 40*b* in the first column may form a gap 45 between them. The biasing members 40 in the second column are offset so that they overlap the gaps 45 formed between the biasing members 40 in the first column. Thus, biasing member 40*c* overlaps the gap 45 between the two biasing members 40*a*, 40*b* and contact is maintained with the media sheets 11 aligned with the gap 45.

Figure 1:
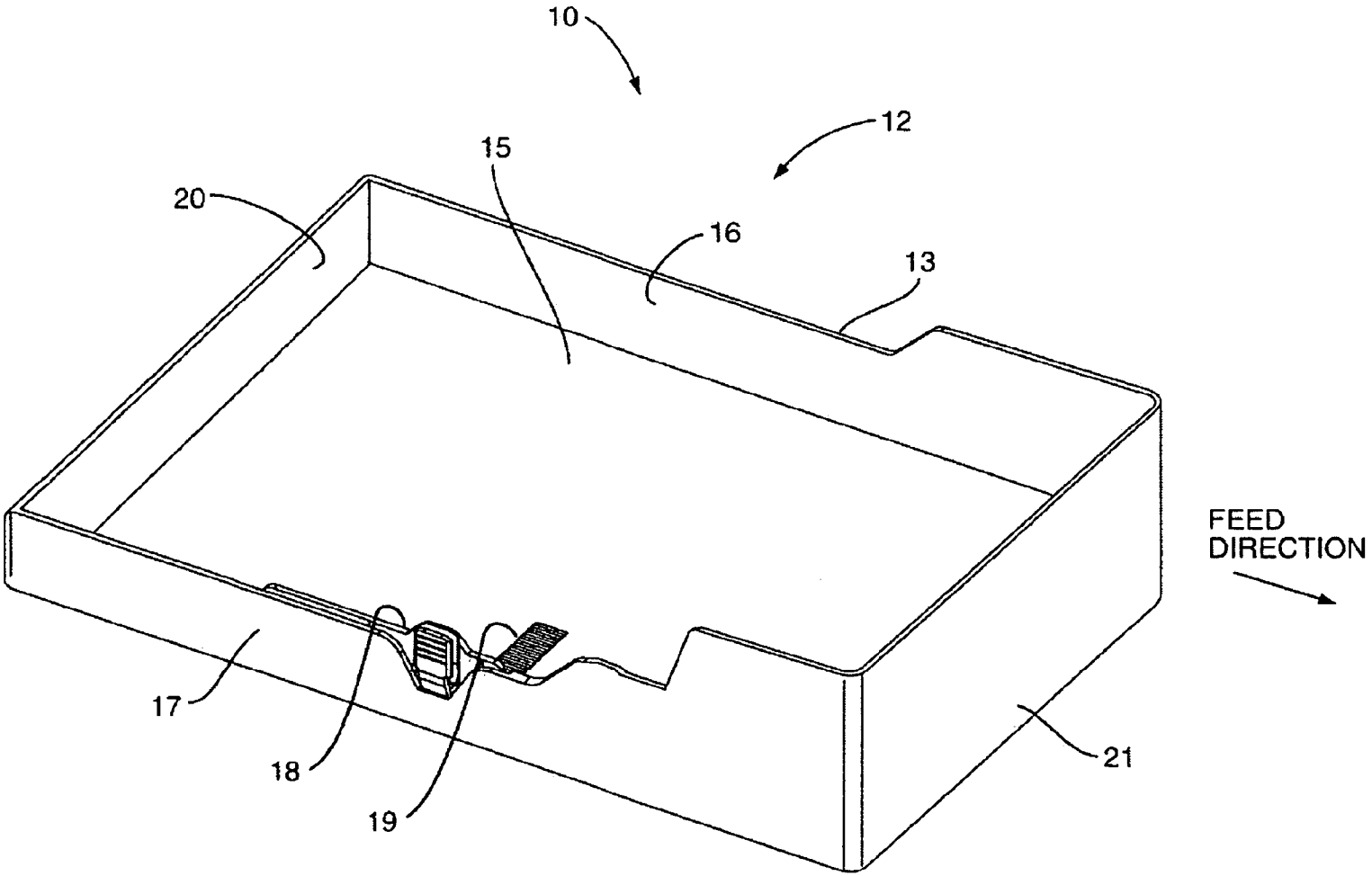
FIG. 1 PRIOR ART
FIG. 1 is a perspective view of a prior art input tray according to one embodiment.
Figure 2:
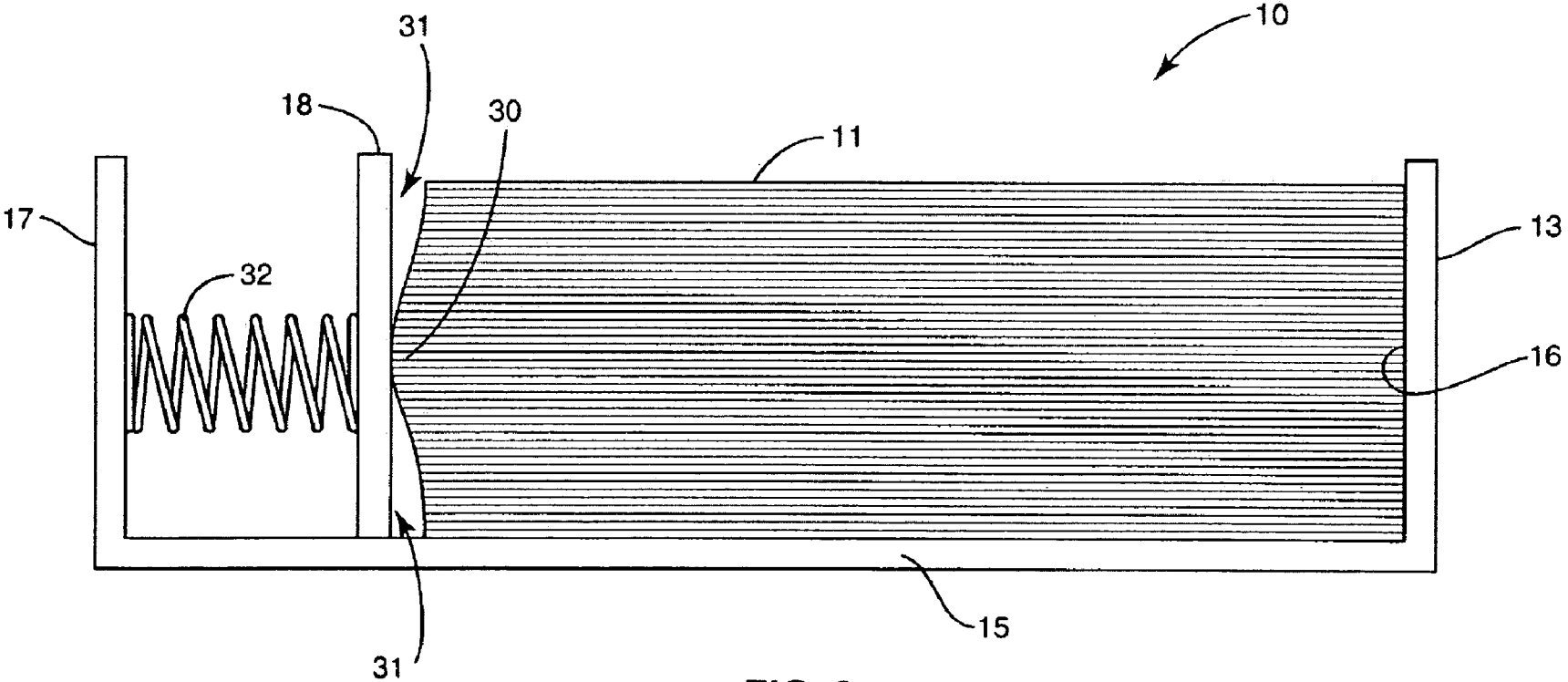
FIG. 2 PRIOR ART
FIG. 2 is a side view of a prior art input tray.

FIG. 7 illustrates a situation similar to that of FIG. 2 where a portion of the stack of media sheets 11 has been misaligned when placed in the input tray 11. The misalignment causes an area 50 where the media sheets 11 are not biased against the reference surface 16. Because of the weight of the media sheets 11 above the misaligned area 50, biasing members 40 located across from the misaligned area 50 may not exert a sufficient force to correct the misalignment. However, as the level of the stack of media sheets 11 drops as media sheets 11 are fed, the weight of the stack above the misaligned area 50 will decrease. Eventually, the weight of the stack may reach a point where the biasing members 40 exert sufficient force to correctly align the media sheets 11 as the top of the stack approaches the misaligned area 50.

Figure 8:
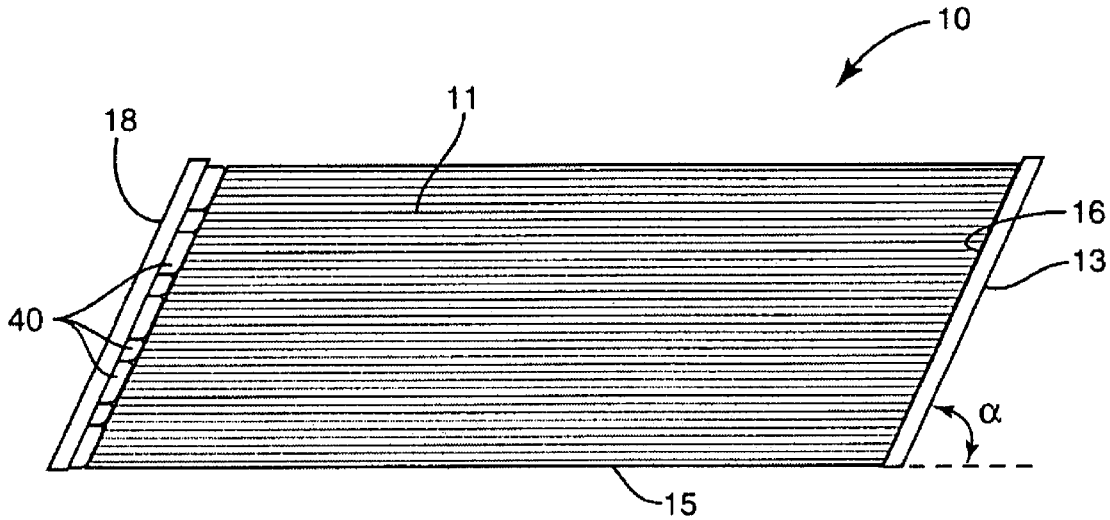
FIG. 8 is a side view of an input tray according to one embodiment.

The biasing members 40 may also be effective to align the media sheets 11 when the first wall 13 and reference surface 16 are positioned at an angle $\alpha$ with respect to the support surface 15 as illustrated in FIG. 8.

Figure 9:
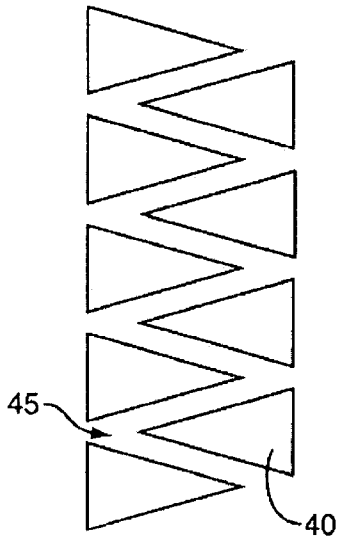
FIG. 9 is a schematic view of biasing members according to one embodiment.
Figure 10:
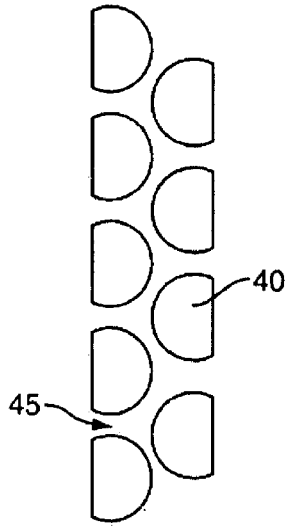
FIG. 10 is a schematic view of biasing members according to one embodiment.
Figure 11:
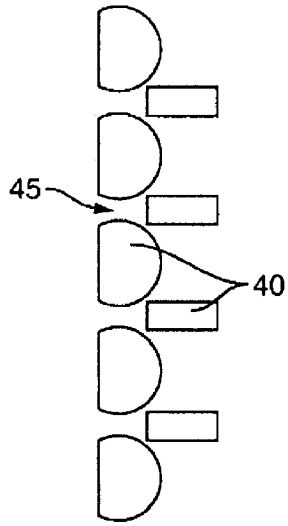
FIG. 11 is a schematic view of biasing members according to one embodiment.

While FIG. 4 illustrates all of the biasing members 40 to be generally rectangular and arranged in vertical columns, other shapes and arrangements are also contemplated. FIG. 9 illustrates an embodiment of overlapping columns of triangular-shaped biasing members 40, and an embodiment of semi-circular biasing members 40 is illustrated in FIG. 10. In addition, the shape of the biasing members 40 may vary between the columns. FIG. 11 illustrates a first column of semi-circular biasing members 40, with a second column of rectangular biasing members 40 offset to overlap the gaps 45 formed between the first column of biasing members 40.

Figure 12:
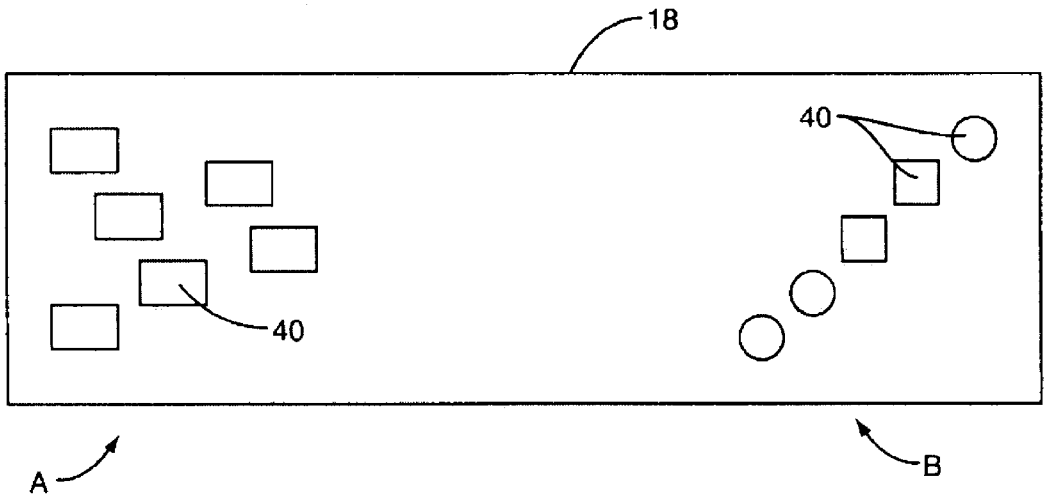
FIG. 12 is a schematic view of biasing members according to one embodiment.

FIG. 12 illustrates an embodiment of biasing members 40 arranged in a variety of patterns other than vertical columns. The biasing members 40 in group A of FIG. 12 are placed in a generally random, overlapping pattern. Group B of FIG. 12 illustrates another embodiment where the biasing members 40 are placed in an angular, overlapping orientation. Group B also illustrates that a variety of shapes of biasing members 40 may be used within each group.

Regardless of the shape or orientation of the biasing members 40, at least some of the biasing members 40 should overlap so that each media sheet 11 is contacted by at least one biasing member 40. Using the embodiment illustrated in FIG. 4, biasing member 40*a* directly contacts a first vertical section of the stack of media sheets 11, biasing member 40*c* directly contacts a second vertical section, and biasing member 40*b* directly contacts a third vertical section. The first vertical section is spaced apart from the third vertical section. Because of the overlapping position of biasing member 40*c* with respect to the other two biasing members 40*a*, 40*b*, biasing member 40*c* simultaneously contacts a limited portion of the first and third vertical sections of the stack of media sheets 11. Thus, each media sheet 11 may be contacted by at least one biasing member 40.

Figure 13:
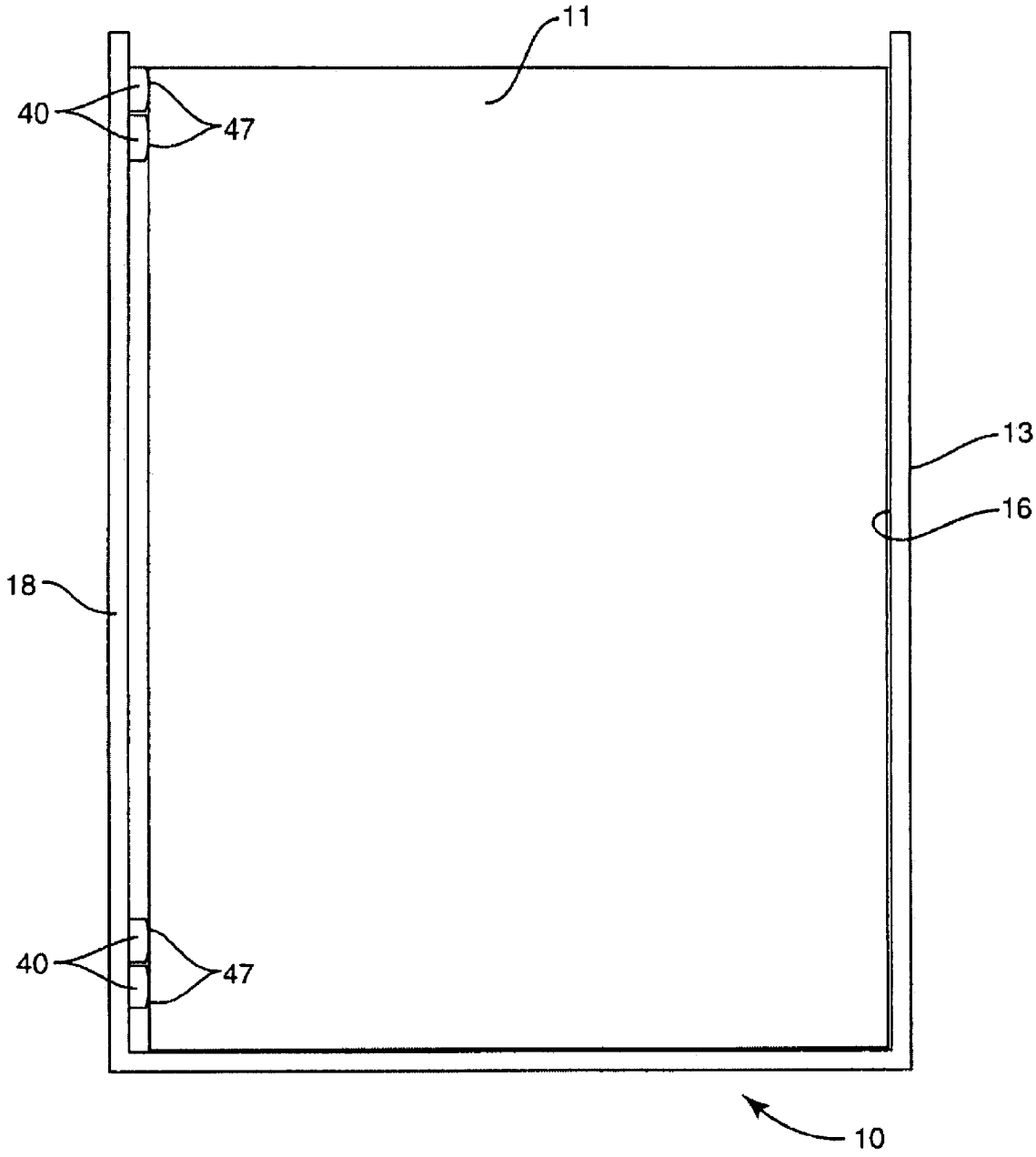
FIG. 13 is a top view of an input tray according to one embodiment.

The shape of the face 47 of the biasing members 40 may affect the performance of the input tray 10. The faces 47 illustrated in FIG. 13 include a gently rounded shape. This shape limits the surface area of the face 47 in contact with the media sheet 11. As the amount of surface area in contact with the media sheet 11 increases, a frictional force between the two may also increase. As a result, a larger force may be applied by a pick mechanism to move the top-most media sheet 11 from the stack. When this force approaches the maximum force the pick mechanism is able to apply, misfeeds may occur. Conversely, if the point of contact between the face 47 and the media sheet 11 becomes too sharp, then the biasing member 40 may indent the edge of the media sheet 11, which can lead to misfeeds and damaged media sheets 11.

Figure 14:
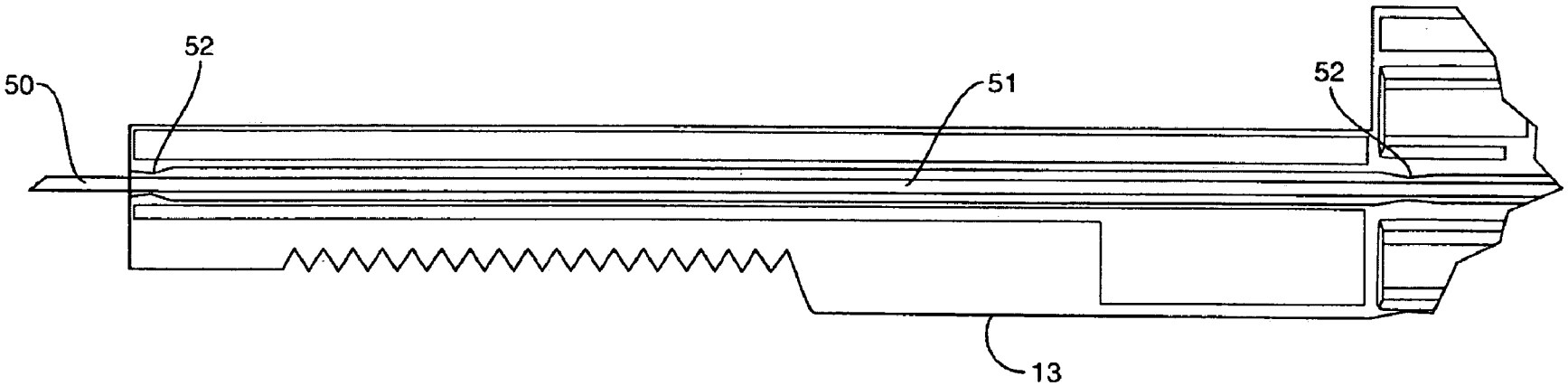
FIG. 14 is a front view of a side wall of an input tray according to one embodiment.

Because the reference surface 16 establishes alignment of the media sheets 11 as they are fed into the image forming device, the alignment of the reference surface 16 to the proper feed path may be critical. One embodiment of a portion of the input tray 1 0.as illustrated in FIG. 14 includes a rail 50 that is oriented square to the media feed path. The first side wall 13 includes a slot 51 adapted to receive the rail 50 therein. The slot 51 includes at least two constraining points 52 that reduces a width of the slot 51. The rail 50 is held firmly at the constraining points 52 when the rail 50 is placed within the slot 51, allowing essentially no movement between the first side wall 13 and the rail 50. Therefore, the first side wall 13, and the reference surface 16, are positioned square to the rail and the media feed path.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An input tray for an image forming device, comprising:

a first side comprising a reference surface adapted to align a stack of media sheets to feed into the image forming device;

a second side comprising a set of biasing members disposed in at least two spaced apart groups, each group of biasing members formed in at least two adjacent columns, each column in an overlapping, vertically-aligned arrangement with respect to one another and extending substantially a height of the second side, each biasing member sized to contact a different limited vertical section of the stack of media sheets such that at least one of the biasing members in one of the two columns is immediately adjacent to each media sheet; and a support surface sized to support the stack of media sheets, the support surface extending between the first side and the second side.

2. The input tray of claim 1, wherein at least one biasing member in a first column overlaps a gap formed between two vertically adjacent biasing members in a second column.

3. The input tray of claim 1, wherein each biasing member further comprises one or more spring mechanisms that urge the biasing member to a position extending outwardly from a surface of the second side toward the first side.

4. The input tray of claim 1, wherein each biasing member further comprises a face including a convex shape.

5. The input tray of claim 1, wherein the first side is spaced apart from and oriented generally parallel to the second side.

6. The input tray of claim 1, wherein the second side is oriented at an angle to the support surface.

7. The input tray of claim 1, wherein the second side is movable between predetermined positions on the support surface to change a distance between the first side and the second side to accommodate a variety of media sizes.

8. An input tray for holding a stack of media sheets for an image forming device, comprising:

a first side wall and a biasing side wall spaced apart from the first side wall for holding the stack of media sheet therebetween, the first side wall having a reference surface for aligning the stack of media sheets prior to feeding the media sheets into the image forming device; and at least two groups of biasing members horizontally spaced apart in the biasing side wall, wherein each group of biasing members comprises:

a first plurality of biasing members positioned at a first plurality of aligned vertical positions substantially extending a height of the biasing side wall and located to directly contact a corresponding first plurality of limited vertically aligned sections of the stack of media sheets adjacent thereto, each of the first plurality of biasing members being independently movable; and a second plurality of biasing members positioned adjacent the first plurality of biasing members and at a second plurality of aligned vertical positions substantially extending the height of the biasing side wall and being in a vertically overlapping arrangement with the first plurality of biasing members such that at least one biasing member in one of the first or second pluralities of biasing members is immediately adjacent each media sheet in the media stack, each of the second plurality of biasing members being independently movable and located to directly contact a corresponding second plurality of limited vertically aligned sections of the stack of media being in a vertically overlapping arrangement with the first plurality of limited vertically aligned sections of the stack.

9. The input tray of claim 8, wherein the input tray is positioned to feed the media sheets into the image forming device in a first direction, and the first plurality and second plurality of biasing members are positioned to bias the media sheets in a second direction generally orthogonal to the first direction and toward the reference surface.

10. The input tray of claim 8, wherein a distance between the reference surface and the biasing side wall is adjustable to one or more predetermined distances to accommodate a variety of media sizes.

11. The input tray of claim 8, wherein each biasing member further comprises a spring mechanism operative to urge the biasing member to a position extending outwardly from a surface of the biasing side wall toward the sheets of media.

12. The input tray of claim 8, wherein a face of each biasing member includes a rounded surface in contact with the media sheets.

13. The input tray of claim 8, wherein each biasing member further comprises a face including a convex shape.

* * * * *